US006070725A

United States Patent [19]

Ito et al.

[11] Patent Number: 6,070,725

[45] Date of Patent: Jun. 6, 2000

[54] COSMETIC CONTAINER

[75] Inventors: Kenichi Ito; Tetsuo Kobayashi, both of Chiba; Masahisa Koyama, Ibaraki; Yoshinobu Abe, Chiba, all of Japan

[73] Assignee: Hidan Co., Kashiwa, Japan

[21] Appl. No.: 09/314,345

[22] Filed: May 19, 1999

[30] Foreign Application Priority Data

Jun. 25, 1998 [JP] Japan ..... 10-193608

[51] Int. Cl.[7] ..... B65D 85/72

[52] U.S. Cl. ..... 206/385; 401/78; 401/80

[58] Field of Search ..... 206/385; 401/68, 401/78, 80, 98

[56] References Cited

U.S. PATENT DOCUMENTS 4,813,801 3/1989 Cardia ..... 206/385

5,653,338 8/1997 Tani ..... 206/385

5,873,667 2/1999 Inoue et al. ..... 401/78

5,984,554 11/1999 Bouix ..... 206/385

*Primary Examiner*—David T. Fidei

*Attorney, Agent, or Firm*—Frishauf, Holtz, Goodman, Langer & Chick, P.C.

[57] ABSTRACT

A cosmetic container (10) comprises a housing assembly (1, 3, 4, 7, 9) with an annular projection (8) and a cap assembly (11, 12) with an inner cap member (12) engageable with the annular projection. The inner cap member has a thin wall portion (15) defined between a pair of upper and lower annular external swells (16, 17), which is deformed to provide air-tight engagement with the annular projection in a capped condition. The lower swell (16) acts as a first stopper against removal of the cap assembly from the housing assembly, whereas the upper swell (17) acts as a second stopper against excessive insertion of the housing assembly into the cap assembly.

6 Claims, 5 Drawing Sheets

COSMETIC CONTAINER

BACKGROUND OF THE INVENTION

1. Field of the Invention

The present invention relates to a cosmetic container such as lipstick container. More particularly, the present invention relates to a cosmetic container comprising a housing assembly and a cap assembly with an inner cap member fittable onto the housing assembly.

2. Description of the Prior Art

In the prior art cosmetic containers, the housing assembly includes an insert sleeve that is integrally fitted to the upper end portion of a rotatable outer body. The insert sleeve supports a stationary main body while allowing relative rotation therebetween. A cosmetic holder receiving a lipstick is vertically slidably accommodated in the main body. The upper portion of the insert sleeve has an annular projection which is engaged within a corresponding annular groove of the inner cap member, when the container is capped.

However, in some case, the annular projection of the insert sleeve is positioned at a level somewhat offset from the position of the annular groove of the inner cap member in the capped condition. This could result from displacement in assembling the inner cap member to the outer cap member.

Furthermore, formation of the annular groove on the inner cap member is practically difficult. When the annular groove do not satisfy a prescribed size requirement, the annular projection fails to be tightly engaged with the annular groove, thereby degrading air-tightness of the cosmetic container. Since most of recent cosmetic material is volatile, the cosmetic container is required to have a superior air-tightness, otherwise the cosmetic material received therein tends to be deteriorated in a relatively short period of time.

SUMMARY OF THE INVENTION

Accordingly, it is an object of the present invention to overcome the drawbacks and disadvantages of the prior art cosmetic container.

Another object of the present invention is to provide a novel construction of a cosmetic container having an improved air-tightness in a capped condition.

According to an aspect of the present invention there is provided a cosmetic container comprising a housing assembly with an annular projection and a cap assembly with an inner cap member engageable with the annular projection, characterized in that the inner cap member has a thin wall portion defined between a pair of upper and lower annular external swells, the thin wall portion being deformed to provide air-tight engagement with the annular projection when the housing assembly is capped with the cap assembly, the lower swell acting as a first stopper against removal of the cap assembly from the housing assembly whereas the upper swell acting as a second stopper against excessive insertion of the housing assembly into the cap assembly.

In a preferable embodiment, the swells of the inner cap member has rectangular cross-section.

In another preferable embodiment, the inner cap member has a portion, above the upper swell, that is inwardly thickened for engagement with an upper end portion of a sleeve member having the annular projection.

In still another preferable embodiment, the annular projection of the housing assembly comprises a pair of spaced upper and lower annular projections.

In still another preferable embodiment, the inner cap member has a portion, below the lower swell, having a knurling inside wall.

In still another preferred embodiment, the inner cap member has a portion, below the lower swell, having a thinner wall thickness.

BRIEF DESCRIPTION OF THE DRAWINGS

Other objects and advantages of the present invention can be understood from the following description when read in conjunction with the accompanying drawings in which.

DETAILED DESCRIPTION OF THE PREFERRED EMBODIMENTS

Some preferred embodiments according to the present invention will be described hereinbelow in reference to the accompanying drawings. The same functional parts and elements are shown by the same reference numbers throughout the drawings.

Figure 1A:
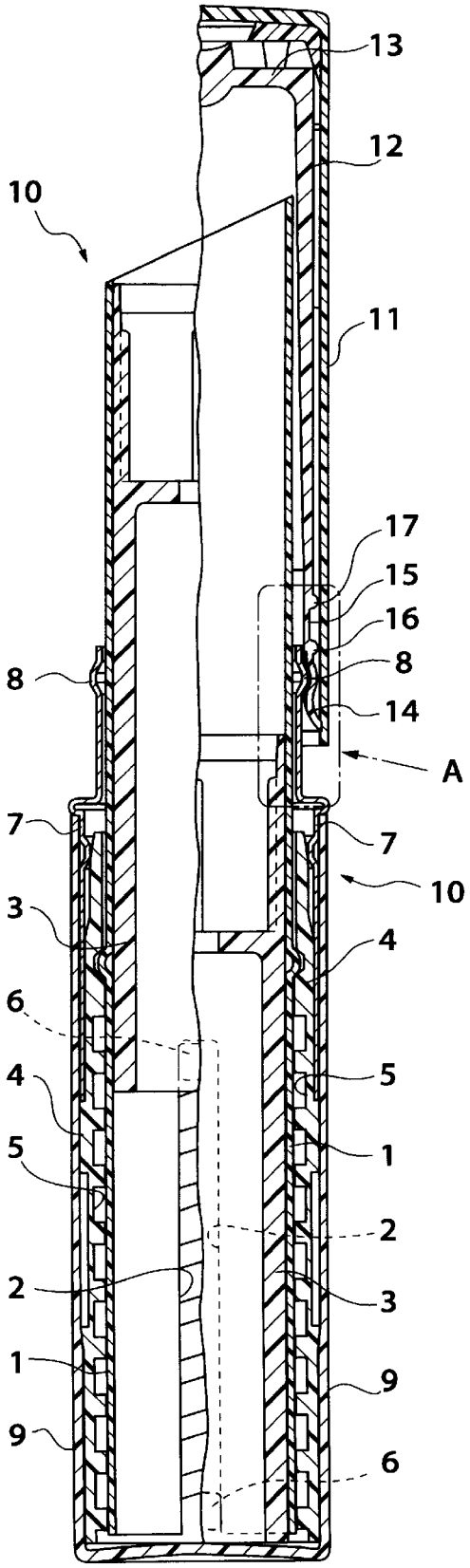
FIG. 1A shows a lipstick container embodying the present invention in an incompletely capped condition, a first half of which is cut along a first axial vertical plane and a second half of which is cut along a second axial vertical plane perpendicular to the first plane.
Figure 1B:
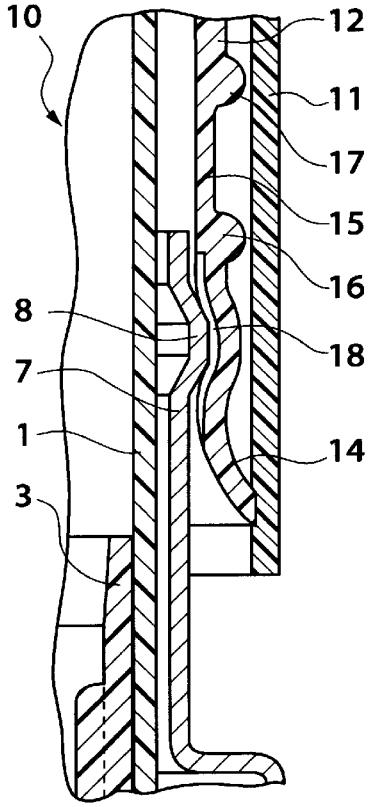
FIG. 1B is an enlarged view showing "A" part in FIG. 1A.
Figure 2A:
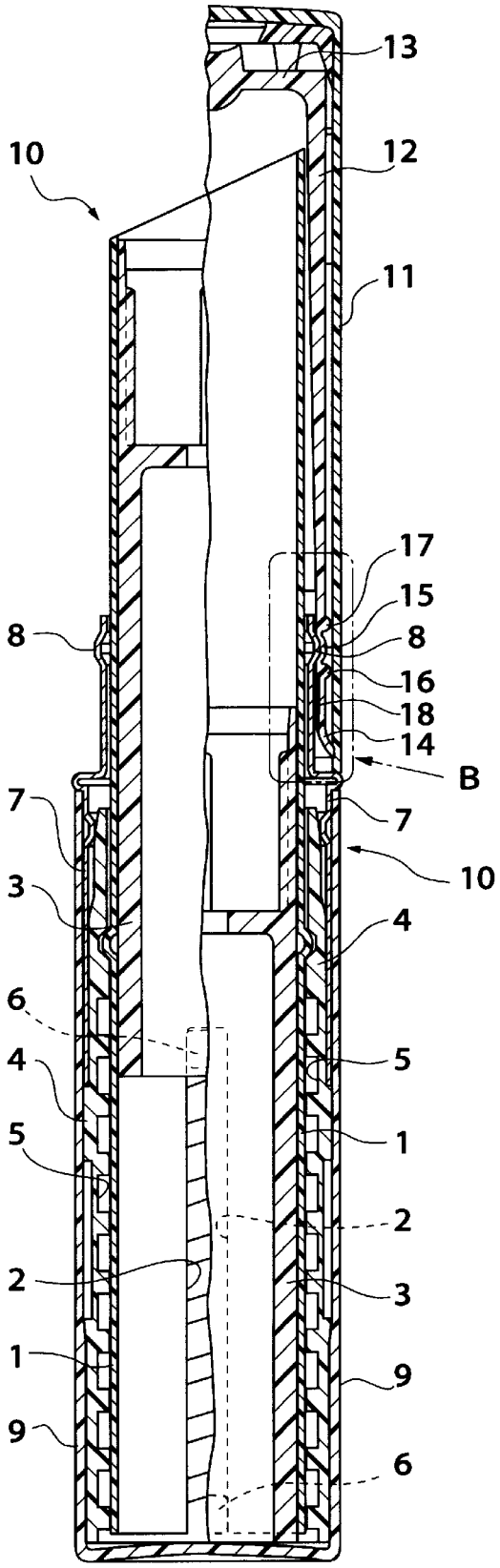
FIG. 2A shows a lipstick container embodying the present invention in a completely capped condition, a first half of which is cut along a first axial vertical plane and a second half of which is cut along a second axial vertical plane perpendicular to the first plane.
Figure 2B:
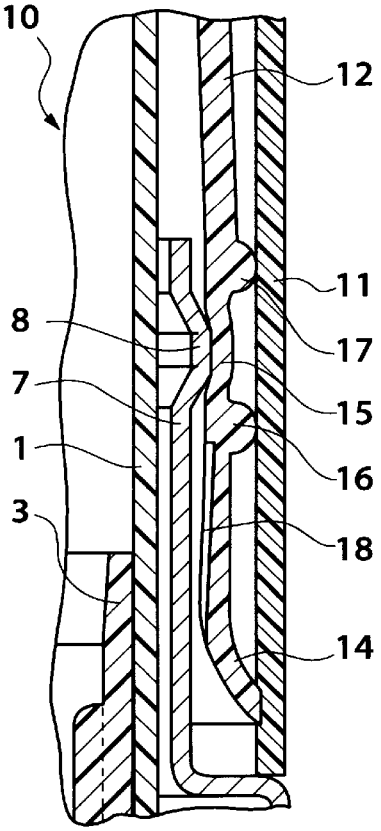
FIG. 2B is an enlarged view showing "B" part in FIG. 2A.

FIGS. 1A, 1B, 2A and 2B illustrate a cosmetic container embodying the present invention, in which it is in an incompletely capped condition in FIGS. 1A and 1B whereas in a completely capped condition in FIGS. 2A and 2B. The cosmetic container 10 comprises, in general, a stationary tubular main body 1, a cosmetic holder 3 that is received in main body 1 and, in turn, accommodates a stick-like cosmetic such as a lipstick (not shown), a rotatable outer body 4 that holds main body 1, a casing 9 integrally press-fit around outer body 4, and a cap 11 mechanically fittable onto an insert sleeve 7 integrally fitted onto the upper end portion of outer body 4. Main body 1 has a pair of opposed vertically elongated slots 2, through which a pair of opposed projections 6, 6 extends outwardly from cosmetic holder 3 to be engaged within a continuous spiral groove 5 on the inner surface of outer body 4. Thus, cosmetic holder 3 is vertically slideable in the stationary main body 1 in response to rotation of casing 9 and outer body 4. Insert sleeve 7 has an annular external ridge 8.

Cap 11 includes a resinous inner cap member 12. Inner cap member 12 is secured to cap 11 at its top 13 and an enlarged bottom 14. The side wall portion of inner cap member 12 has a thinner portion 15 formed between a pair of spaced swells 16, 17. In this embodiment, each swell 16, 17 is defined by a flat inner surface and an external projection of substantially a semi-circular cross-section. Below the lower swell 16, inner cap member 12 has a knurling inside surface 18.

When cap 11 is placed onto sleeve 7, annular external ridge 8 is first positioned in contact with knurling inside surface 18 of inner cap 12, as best seen in FIG. 1B. Then, by applying a downward force to cap 11, lower swell 16 climbs over ridge 8, as shown in FIG. 2B. In this state, ridge 8 rests at the thinner portion 15 which is easily deformed to be tightly adhered to ridge 8, thereby providing an improved air-tight property to container 10. Accordingly, container 10 is suitable to receiving a volatile cosmetic material which is prevented from deterioration during a longer period of time. The upper swell 17 is less deformable and therefore acts as a stopper for preventing excessive insertion of sleeve 7. The lower swell 16 acts as another stopper for preventing unintended removal of cap 12. Since the thinner portion 15 is simply formed as a straight extending tubular section, even if there is some displacement in engagement between cap 11 and inner cap member 12, ridge 8 is surely positioned inside of portion 15 in the capped condition as shown in FIG. 2B.

Figure 3A:
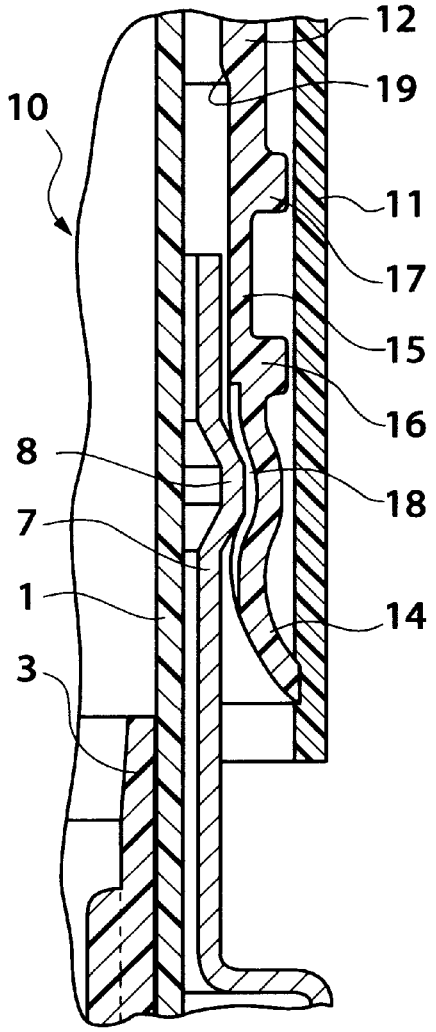
FIGS. 3A and 3B are enlarged sectional views showing another embodiment of the present invention in an incompletely capped condition and in a completely capped condition, respectively.
Figure 3B:
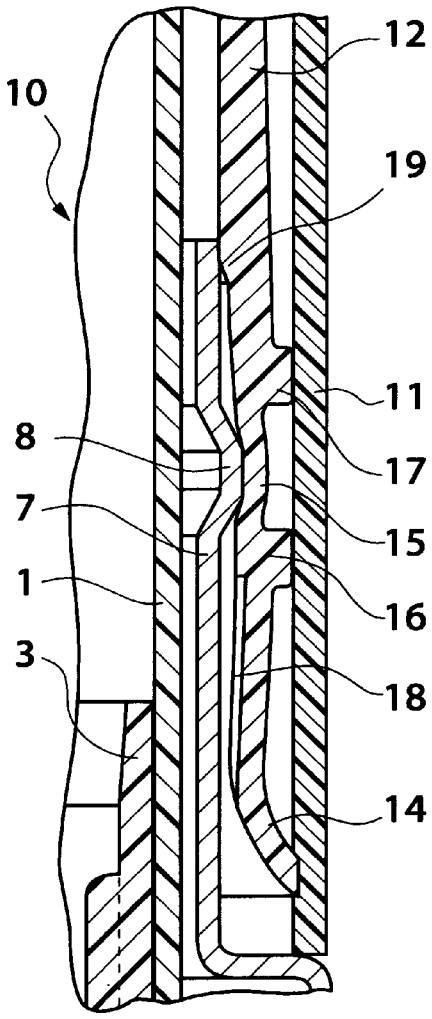

Although a preferred embodiment of the present invention has been described in detail in reference to the accompanying drawings, it is to be understood that many variations and modifications may be made without departing from spirits and scopes of the present invention as defined in the appended claims. For example, the thicker portions 16, 17 of inner cap member 12 may have any desired configuration, another example of which is shown in FIGS. 3A and 3B in which they are formed as annular stripes of rectangular cross-section. This modification provides greater contact areas between stripes 16, 17 and the inner surface of cap 11 and, therefore, more improved air-tightness.

Figure 5A:
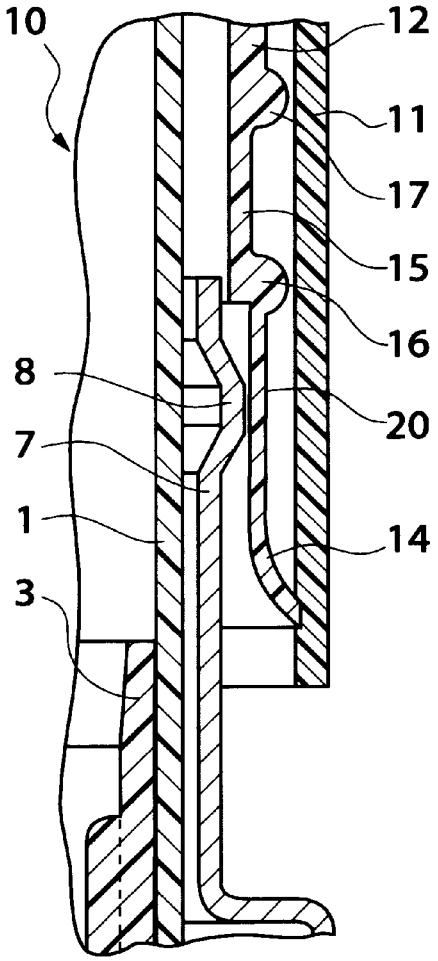
FIGS. 5A and 5B are enlarged sectional views showing another embodiment of the present invention in an incompletely capped condition and in a completely capped condition, respectively.
Figure 5B:
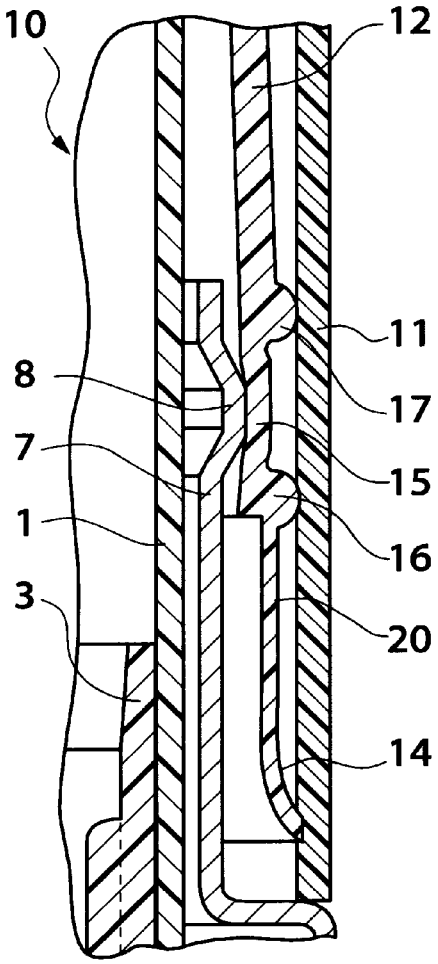

Inner cap member 12 may have different details as far as it provides the thinner wall portion 15 formed between lower and upper swells 16, 17. For example, as shown in FIGS. 3A and 3B, the inside wall of inner cap member 12 may be somewhat thickened at a portion 19 above the upper swell 17 for contact with the upper end of sleeve 7 when cap 11 is tightly capped (FIG. 3B) thereinto. This provides better air-tightness of container 10. In another modification shown in FIGS. 5A and 5B, the lower portion 20 of inner cap member 12 has a thinner wall thickness for easier capping operation.

Figure 4A:
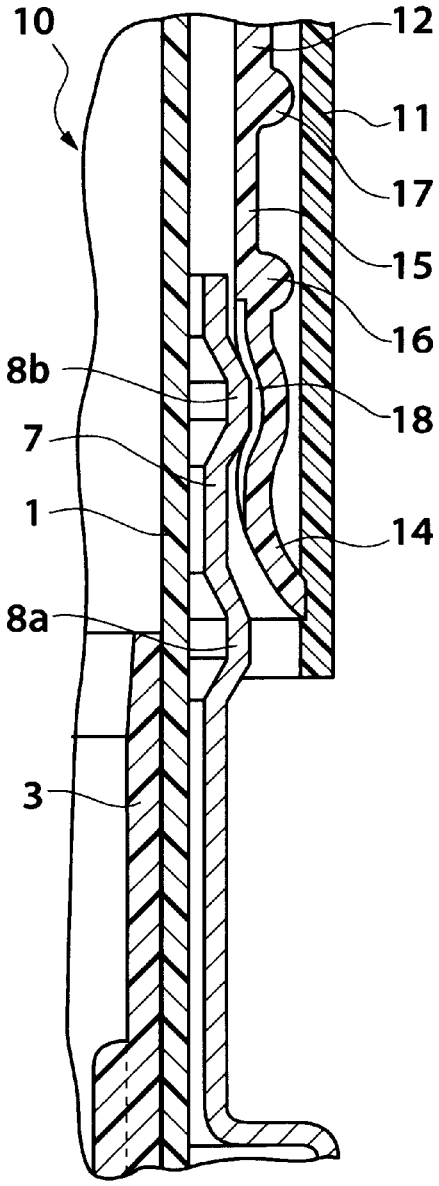
FIGS. 4A and 4B are enlarged sectional views showing still another embodiment of the present invention in an incompletely capped condition and in a completely capped condition, respectively.
Figure 4B:
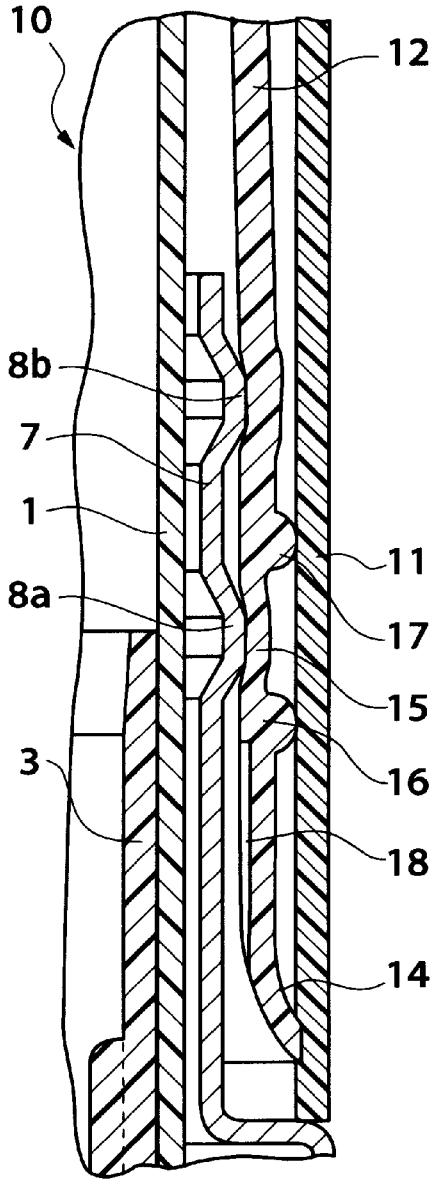

Sleeve 7 may have plural annular ridges 8*a*, 8*b* as shown in FIGS. 4A and 4B. In this modification, the lower ridge 8*a* is engaged with the deformable portion 15 of inner cap member 12, whereas the upper ridge 8*b* is positioned above the upper swell 17 in the capped condition (FIG. 4B). In other words, the lower swell 16, the lower ridge 8*a*, the upper swell 17 and the upper ridge 8*b* are arranged in a zigzag alignment which provides most preferable air-tightness of container 10.

The cosmetic container of the present invention is generally cylindrical but its shape, size and material is not limitative. The cosmetic container of the present invention is particularly used as a lipstick container but may be used for receiving any cosmetic material that is volatile or not.

What is claimed is:

1. A cosmetic container comprising a housing assembly with an annular projection and a cap assembly with an inner cap member engageable with said annular projection, wherein said inner cap member has a thin wall portion defined between a pair of upper and lower annular external swells, said thin wall portion being deformed to provide air-tight engagement with said annular projection when said housing assembly is capped with said cap assembly, said lower swell acting as a first stopper against removal of said cap assembly from said housing assembly and said upper swell acting as a second stopper against excessive insertion of said housing assembly into said cap assembly.

2. A cosmetic container according to claim 1 wherein said swells of said inner cap member have a rectangular cross-section.

3. A cosmetic container according to claim 1 wherein said inner cap member has a portion, above said upper swell, that is inwardly thickened for engagement with an upper end portion of a sleeve member having said annular projection.

4. A cosmetic container according to claim 1 wherein said annular projection of said housing assembly comprises a pair of spaced upper and lower annular projections.

5. A cosmetic container according to claim 1 wherein said inner cap member has a portion, below said lower swell, having a knurled inside wall.

6. A cosmetic container according to claim 1 wherein said inner cap member has a portion, below the lower swell, having a thinner wall thickness.

* * * * *